United States Patent [19]

Sato et al.

[11] Patent Number: 4,572,684

[45] **Date of Patent: * Feb. 25, 1986**

[54] HEAT-SENSITIVE COLOR TRANSFER RIBBON

[75] Inventors: Tadao Sato, Matsudo; Yoshikazu Shimazaki, Takatsuki, both of Japan

[73] Assignee: Fuji Kagakushi Kogyo Co., Ltd., Osaka, Japan

[ * ] Notice: The portion of the term of this patent subsequent to Mar. 5, 2002 has been disclaimed.

[21] Appl. No.: 659,034

[22] Filed: Oct. 10, 1984

Related U.S. Application Data

[63] Continuation of Ser. No. 361,198, Mar. 24, 1982, abandoned, which is a continuation-in-part of Ser. No. 215,838, Dec. 12, 1980, abandoned.

[30] Foreign Application Priority Data

Jan. 7, 1980 [JP] Japan ..... 55-678

[51] Int. Cl.[4] ..... B41J 3/20

[52] U.S. Cl. ..... 400/240.4; 400/120; 427/265

[58] Field of Search ..... 427/265

[56] References Cited

U.S. PATENT DOCUMENTS

| | | | |
|---|---|---|---|
| 2,084,026 | 6/1937 | Gurwick | 101/426 |
| 3,461,998 | 8/1969 | Ploeger, Jr. | 400/241.4 |
| 3,744,611 | 7/1973 | Montanari et al. | 400/120 |
| 3,855,448 | 12/1974 | Hanagata et al. | 400/120 |
| 3,989,131 | 11/1976 | Knirsch et al. | 400/120 |
| 4,065,158 | 12/1977 | Davis | 428/914 |
| 4,195,937 | 4/1980 | Baran | 400/120 |
| 4,251,276 | 2/1981 | Ferree, Jr. et al. | 400/120 |
| 4,280,767 | 7/1981 | Heath | 400/240.4 |
| 4,289,069 | 9/1981 | Melissa et al. | 400/240.3 |
| 4,503,095 | 3/1985 | Seto | 400/240.3 |

FOREIGN PATENT DOCUMENTS

| | | | |
|---|---|---|---|
| 1943094 | 3/1971 | Fed. Rep. of Germany | 101/461 |

OTHER PUBLICATIONS

Skinner "Digital Color Printer" IBM Technical Disclosure Bulletin, vol. 21, No. 5, pp. 1828–1829.

*Primary Examiner*—William Pieprz

*Attorney, Agent, or Firm*—Armstrong, Nikaido, Marmelstein & Kubovcik

[57] ABSTRACT

Heat-sensitive color transfer ribbon comprising a foundation having at least three nonoverlapped heat-sensitive transfer ink layers of yellow, magenta and cyan colors on one side thereof and designed for use in thermal color recording system in which the ribbon transfers respective color ink layers to a copy sheet in response to respective color signals given to a thermal recording machine. The transfer ink layers of yellow, magenta and cyan colors contain respective transparent or semitransparent color agents, and a multi-color image closely resembling a color original is prepared on the copy sheet by overlap of colors.

6 Claims, 7 Drawing Figures

HEAT-SENSITIVE COLOR TRANSFER RIBBON

This application is a continuation, of application Ser. No. 361,198, filed Mar. 24, 1982, which is a continuation-in-part application of parent Ser. No. 215,838, filed Dec. 12, 1980, both now abandoned.

BACKGROUND OF THE INVENTION

The present invention relates to a novel heat-sensitive color transfer ribbon, and more particularly to a heat-sensitive color transfer ribbon suited for producing color copies in a thermal recording system.

In recent years, a thermal printer and a facsimile of thermal recording type are commonly employed from the viewpoint of the advantages such as maintenance free and low cost. A heat transfer ribbon or carbon paper having a layer of a heat-transfer ink composition on a foundation is usually employed as a recording medium in a thermal printer and thermal facsimile, and various improvements of the ribbon and carbon paper, e.g. in fastness of the transferred image, are proposed. A known thermal printer and thermal facsimile are of the type producing a duplicate of single color such as black or blue, and there is desired the development of a thermal color printer and thermal color facsimile.

As a color recording system, there are known an impact recording system as seen in a usual typewriter in which a cloth ribbon, e.g. a ribbon coated with inks of two colors, is employed; and an ink-jet recording system in which inks are jetted by employing two or more ink-jet heads. The former has the disadvantages of a large noise and slow recording speed. Also, the latter has the disadvantages that troubles such as choking of a nozzle for jetting out an ink are easy to occur and that since the amount of ink jetted must be controlled, the apparatus itself becomes intricate and expensive and is also complicated to operate.

On the other hand. there has been lately proposed a color recording system applying the principles of color television and color phototelegraphy. FIG. 1 is a diagrammatic view showing such a color recording system. A color original 1 is subjected to color separation by color separation filters 21, 22 and 23. The respective color-separated images are then read by photoelectric tubes 31, 32 and 33, and are converted into yellow signal Y, cyan signal C and magenta signal M. The signals are transmitted from a transmitter 4 to a receiver 5 at which the signal separation is conducted again. The signals are transmitted to a printer 6 to reproduce a color image which closely resembles the original, on a copy sheet 7. Recording machines applicable to such a system have been proposed and developed. The application of a thermal printer as a printer 6 is advantageous in points of low cost, easiness in operation, low noise and high printing speed It is an object of the present invention to provide a novel recording medium applicable to a thermal printer in a color recording system as mentioned above.

A further object of the invention is to provide a heat-sensitive transfer ribbon intended for the application to a thermal color recording system by which color image closely resembling a color original can be reproduced on a copy sheet.

These and other objects of the present invention will become apparent from the following description with reference to the accompanying drawings.

SUMMARY OF THE INVENTION

In accordance with the present invention, there is provided a heat-sensitive transfer ribbon comprising a foundation having at least three nonoverlapped heat-sensitive transfer ink layers of yellow, magenta and cyan colors on one side thereof, and the heat-sensitive transfer ink layers containing respective transparent and semitransparent coloring agents.

DETAILED DESCRIPTION

Figure 1:
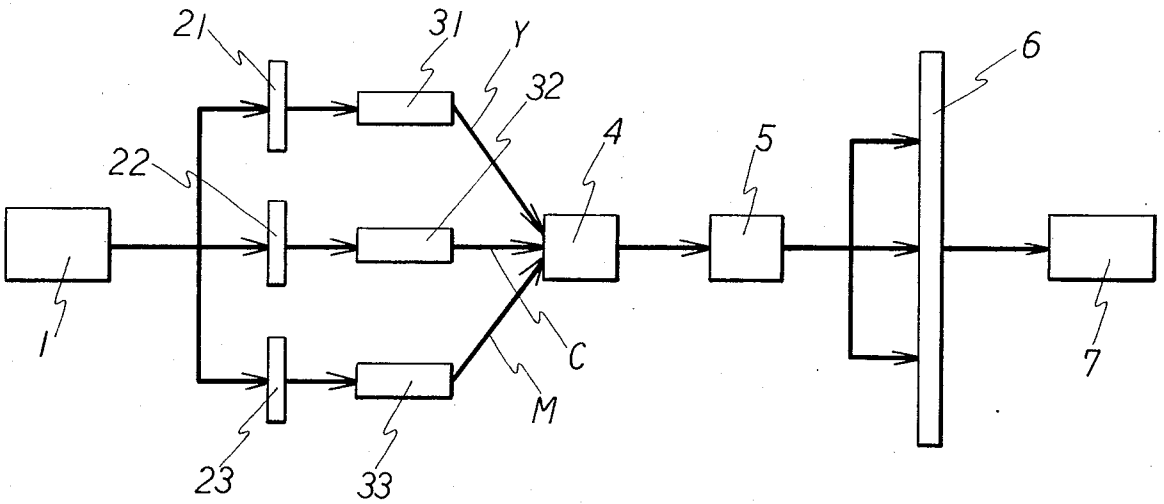
FIG. 1 is a diagrammatic view showing a color recording system.
Figure 2:
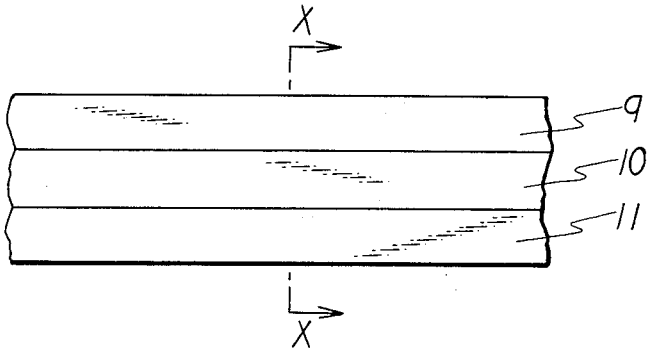
FIG. 2 is a schematic plan view showing an embodiment of a heat transfer color ribbon of the present invention.
Figure 3:
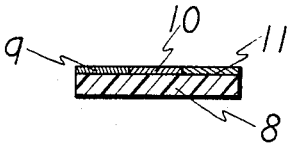
FIG. 3 is a schematic section view taken on line X—X of FIG. 2.

Referring to FIGS. 2 to 3, a heat-sensitive color transfer ribbon of the present invention has three heat-sensitive transfer ink layers 9, 10 and 11 of yellow, magenta and cyan colors on one side of a foundation 8 along with its longitudinal direction. The three ink layers 9, 10 and 11 of yellow, magenta and cyan colors are formed on the respective areas of the foundation 8 so that one color layer do not substantially overlap with another color layer. Yellow, magenta and cyan colors are primary colors in a color recording medium, since color images closely resembling a color original can be reproduced on a copy sheet by formation of images corresponding to respective color signals obtained by color separation of the original through separation filters, i.e. three-color filters of blue, green and red. The ink layers of these colors are formed by applying heat-sensitive transfer ink compositions containing coloring agents of yellow, magenta and cyan colors. As coloring agents, there can be used respective transparent or semitransparent coloring agents which are capable of forming various colors by overlapping two or three of the primary colors, i.e. yellow, magenta and cyan colors.

As coloring agents of yellow, magenta and cyan colors, one or more of the transpatent or semitransparent pigments or dyes can be preferably used. Examples of the yellow pigment are Chrome Yellow, Zinc Yellow, Barium Chromate, Cadmium Yellow. Naphthol Yellow S, Hansa Yellow 10 G, Hansa Yellow 5 G, Hansa Yellow 3 G, Hansa Yellow G, Hansa Yellow GR. Hansa Yellow A, Hansa Yellow RN, Hansa Yellow R, Benzidine Yellow, Benzidine Yellow G, Benzidine Yellow GR, Permanent Yellow NCG, Quinoline Yellow Lake, or the like, and examples of the yellow dye are Auramine, or the like.

Examples of the magenta pigment are Permanent Red 4R, Brilliant Fast Scarlet, Brilliant Carmine BS, Permanent Carmine FB, Lithol Red, Permanent Red F5R. Brilliant Carmine 6B, Pigment Scarlet 3B, Rhodamine Lake B, Rhodamine Lake Y, Alizarine Lake, or the like, and examples of the mangenta dye are Rhodamine, or the like.

Examples of the cyan pigment are Victoria Blue Lake, metal-free phthalocyanine blue, Phthalocyanine Blue, Fast Sky Blue, or the like, and examples of the cyan dye are Victoria Blue, or the like.

The above pigments of yellow, magenta, cyan colors are those capable of coloring transparently or semi-transparently when dispersing into a vehicle such as binder and softening agent. Each coloring agent is contained in the heat-sensitive transfer ink layer at a range of 1 to 20 parts by weight, more preferably 1 to 20 parts by weight per 100 parts by weight of total amount of the ink layer. When the content of the coloring agent is more than the above range, the transparency of the ink layer is lowered so that color reproduction becomes difficult and when the content of the coloring agent is less than the above range, a tinting strength of the ink layer is lowered.

Figure 4:
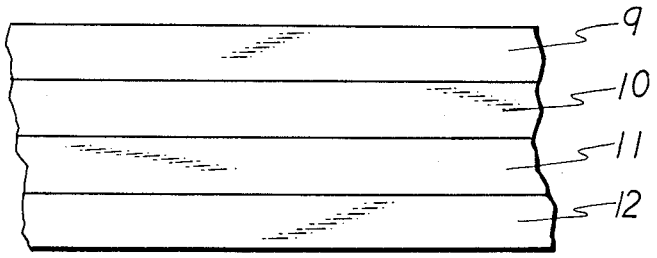
FIGS. 4, 5 and 6 are schematic plan views showing other embodiments of heat transfer color ribbons of the present invention.

As shown in FIG. 4, the heat transfer color ribbon may further have a heat-sensitive transfer ink layer 12 of black color in addition to the transfer ink layers 9, 10 and 11 of yellow. magenta and cyan colors for the purose of reproducing sharp black image. The black transfer ink layer 12 is formed from a heat-sensitive transfer ink composition containing a black coloring agent such as carbon black or Nigrosine Base.

Figure 7:
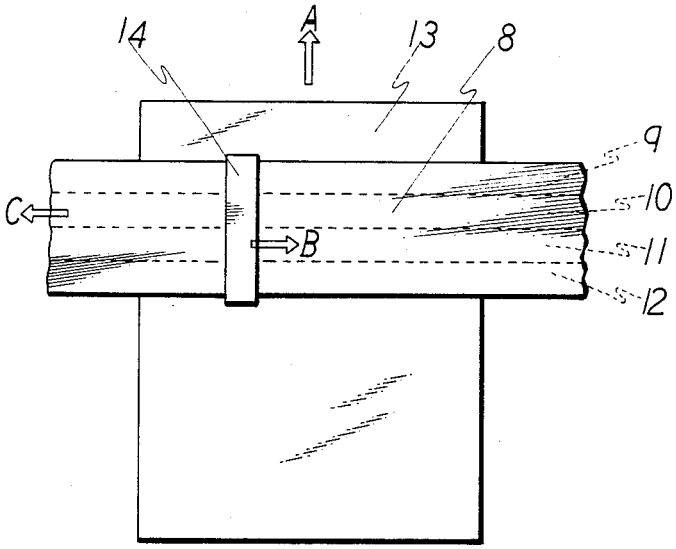
FIG. 7 is an illustrative view showing a manner of forming a color image by employing a heat transfer color ribbon of the present invention.

As shown in FIG. 7, the heat transfer ribbon of the invention having the yellow, magenta, cyan and black ink layers 9, 10, 11 and 12 on the foundation 8 is employed as a recording medium in a thermal printer in which the ribbon is positioned with the ink layer facing a copy sheet 13 such as a plain paper and the printing is conducted by a thermal head 14 heating the back side of the foundation 8. For instance. the copy sheet 13 moves in the direction A in synchronism with the movement of the thermal head 14 in the direction B. Simultaneously, the thermal head 14 generates heat by pulse signals from a usual signal treating device at positions corresponding to respective colors on the basis of input color signals of yellow, magenta, cyan and black transmitted into a printer so as to melt-transfer the heat-sensitive transfer ink layers 9, 10, 11 and 12 onto the copy sheet 13 and to form a color image (not shown) which closely resembles a color original. The heat transfer ribbon moves in the direction C in synchronism with the movement of the thermal head 14 in the direction B. The copy sheet 13 and the thermal head 14 may move in opposite directions to the directions A and B, respectively.

As a foundation 8, there are preferably employed those having an adequate heat resistance and good heat conductivity. Preferable examples of the foundation employed in the present invention are plastic films and papers having thickness of 3 to 25$\mu$ and a density of 0.9 to 1.4 g./cm.$^3$, such as polyethylene film, polystyrene film, polypropylene film, glassine paper, synthetic paper and laminated paper.

The heat-sensitive transfer ink layer is formed by coating a heat-sensitive transfer ink composition to the foundation. The transfer ink composition contains 20 to 80 parts by weight of a binder and 3 to 25 parts by weight of a softening agent per 100 parts by weight of the total amount of the ink layer in addition to the above coloring agent. The coating may be carried out by means of hot melt coating or solvent coating. The thickness of the transfer ink layer is usually selected from 1 to 10$\mu$.

A solid wax having a penetration of 10 to 30 (at 25° C.) is preferably employed as a binder from the viewpoint of the heat sensitivity of the obtained transfer ink layer. For instance, waxes such as haze wax, beeswax, ceresine wax and spermaceti are preferred. The solid wax may be employed in combination with an easily meltable material such as a low molecular weight polyethylene, oxidized wax or ester wax, as occasion demands As a softening agent, there is desirably employed an easily heat-meltable material such as polyvinyl acetate. polystyrene, styrene-butadiene copolymer, cellulose esters, cellulose ethers or acrylic resins, and a lubricating oil such as a mineral oil.

In order to provide the heat-sensitive transfer ink layer with a good heat conductivity and melt-transferability, a finely divided heat conductive material, an extender pigment or the mixture thereof may be added to the heat-sensitive transfer ink composition. Examples of the heat conductive material are a metal powder having a heat conductivity of $6.0\times10^{-4}$ to $25.0\times10^{-4}$ cal/sec.cm.°C. such as aluminum, copper, tin or zinc. Examples of the extender pigment are magnesium carbonate, calcium carbonate, clay, kaolin, calcium silicate, high dispersive silicic acid anhydride (commercial name "Aerosil" made by Nippon Aerosil Kabushiki Kaisha) and white carbon. An extender pigment having a relatively high transparency is preferred. The heat conductive material and the extender pigment are employed in amounts of 0 to 30 parts by weight and 0 to 10 parts by weight, respectively, per 100 parts by weight of the total solids of the heat-sensitive transfer ink composition.

It is desirable in points of the melt-transferability that the thus obtained respective heat-sensitive transfer ink layers 9, 10, 11 and 12 have a melting point of 50° to 150° C. and a viscosity of 20 to 10,000 cP at a temperature of 30° C. higher than the melting point. Also, it is desirable that the transfer ink layers are rather hard, since the soft layers are easily soiled, and accordingly there are preferred the transfer ink layers having a penetration of 0.1 to 50 according to Japanese Industrial Standard K 2530.

Figure 5:
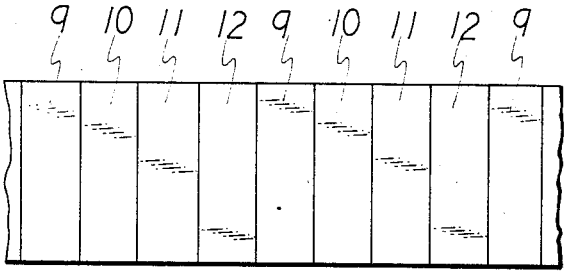
Figure 6:
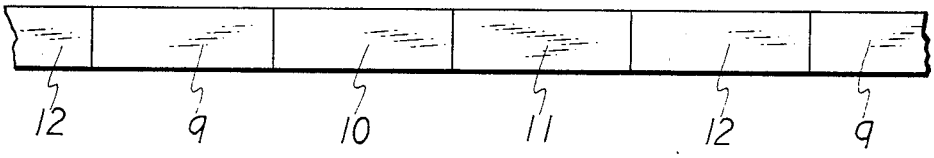

Upon the formation of heat-sensitive transfer ink layers, for instance, respective heat-sensitive transfer ink compositions may be applied to the foundation 8 to form the transfer ink layers 9, 10, 11 and 12 in stripes in the longitudinal direction of the foundation 8 as shown in FIGS. 2 and 4, or in stripes in the transverse direction of the foundation 8 in prescribed color order as shown in FIGS. 5 and 6.

The heat transfer color ribbons shown in FIGS. 5 and 6 may be used in the similar manner to the color printing method as shown in FIG. 7. According to FIG. 6, the widths of respective color stripes in the longitudinal direction of the foundation 8 are substantially the same as that of the copy sheet so that each strip is faced with the copy sheet. Therefore, the images of the respective colors are transferred onto the same area of the copy sheet by the thermal heat 14 to form the multi-color image due to overlaps of colors.

The heat-sensitive transfer ribbon of the present invention is very suited for use in a thermal color recording system in which the heat-sensitive transfer ink layers of respective colors are melt-transferred to a copy sheet by means of a thermal head heated by pulse signals corresponding to signals of the respective colors. Since the amounts of the ink layers transferred can be controlled by changing the intensity of the pulse signal given to the thermal head of a printer, it is possible to obtain middle tone and accordingly to reproduce a color image faithful to the color tone of an original. Further, the heat transfer ribbon of the present invention can produce the effects that the obtained multicolor image has a good fastness and the running cost is inexpensive because a usual paper can be used as a copy sheet. The contribution of the heat transfer ribbon of the present invention to the development of color printer, color facsimile, color video printer and color copying machine is really great, and the heat transfer ribbon of the invention is of great practical value.

What we claimed is:

1. A heat-sensitive color transfer ribbon applicable to a thermal printer in a color recording system for preparing on a copy sheet a multi-color image by means of overlaps of colors, comprising a foundation having a least three nonoverlapped heat-sensitive transfer ink layers of yellow, cyan and magenta colors on one side thereof; each of said three different color ink layers being substantially transparent and capable of transferring substantially permanently-existing overlapping portions of at least two different color ink layers and having a thickness of 1 to 10$\mu$, a melting point of 50° C. to 150° C., a viscosity of 20 to 10,000 cP at a temperature higher than the melting point by 30° C., and a penetration of 0.1 to 50° at 25° C., and containing 1 and 20% by weight of a coloring agent, 20 to 80% by weight of a solid wax as a binder and 3 to 25% by weight of a softening agent; and said coloring agent being at least one of dyes and organic pigments, the organic pigments being those capable of coloring the transfer ink substantially transparently when dispersed into the vehicle composed of the wax and the softening agent.

2. The heat-sensitive color transfer ribbon of claim 1, wherein the heat-sensitive transfer ink layer of black color is further provided on said one side of the foundation.

3. The heat-sensitive transfer ribbon of claim 1, wherein said foundation is a plastic film or a paper, said plastic film or paper having a thickness of 3 to 25$\mu$ and a density of 0.9 to 1.4 g./cm.$^3$.

4. The heat-sensitive transfer ribbon of claim 1, wherein said heat-sensitive transfer ink layers are formed on the foundation in stripes in the transverse direction of the foundation in repeated, prescribed color order.

5. The heat-sensitive transfer ribbon of claim 1, wherein said heat-sensitive transfer ink layers are formed on the foundation in stripes in the longitudianl direction of the foundation.

6. A process for printing a color image which comprises the steps of:

providing a heat-sensitive color transfer ribbon comprising a foundation and at least three nonoverlapped heat-sensitive transfer ink layers of yellow, cyan and magenta colors provided on one side of the foundation; each of said three different color ink layers being substantially transparent and having a thickness of 1 to 10$\mu$, a melting point of 50° to 150° C., a viscosity of 20 to 10,000 cP at a temperature higher than the melting point by 30° C., and a penetration of 0.1 to 50 at 25° C., and containing 1 to 20% by weight of a coloring agent, 20 to 80% by weight of a solid wax as a binder and 3 to 25% by weight of a soltening agent; and said coloring agent being at least one of dyes and organic pigments, the organic pigments being those capable of coloring the transfer ink substantially transparently when dispersed into the vehicle composed of the wax and the softening agent; and melt-transferring the different color heat-sensitive transfer ink layers of the transfer ribbon onto a receiving medium by means of a thermal head so that the portions of at least two different color ink layers, that are heated with the termal head, are transferred overlapping with each other on the receiving medium to provide a colored image, the overlapping portions of the at least two different color ink layers continuing to exist as substantially separate overlapped layers.

* * * * *

UNITED STATES PATENT AND TRADEMARK OFFICE

CERTIFICATE OF CORRECTION

PATENT NO. : 4,572,684

DATED : February 25, 1986

INVENTOR(S) : TADAO SETO ET AL

It is certified that error appears in the above-identified patent and that said Letters Patent is hereby corrected as shown below:

On the cover page, Item [75], change "Tadao Sato" to --- Tadao Seto ---.

Signed and Sealed this

*Tenth* Day of *June 1986*

[SEAL]

*Attest:*

DONALD J. QUIGG

*Attesting Officer*

*Commissioner of Patents and Trademarks*